US007484496B2

(12) United States Patent
Murakami

(10) Patent No.: US 7,484,496 B2
(45) Date of Patent: Feb. 3, 2009

(54) THROTTLE APPARATUS EMBEDDING ELECTRONIC CONTROL UNIT THEREIN

(75) Inventor: Tsutomu Murakami, Kanagawa-ken (JP)

(73) Assignee: Nikki Co., Ltd. (JP)

( * ) Notice: Subject to any disclaimer, the term of this patent is extended or adjusted under 35 U.S.C. 154(b) by 0 days.

(21) Appl. No.: 11/898,267

(22) Filed: Sep. 11, 2007

(65) Prior Publication Data

US 2008/0223337 A1 Sep. 18, 2008

(30) Foreign Application Priority Data

Sep. 12, 2006 (JP) ..... 2006-246353

(51) Int. Cl.
*F02D 9/08* (2006.01)

(52) U.S. Cl. ..... 123/337; 123/399

(58) Field of Classification Search ..... 123/337, 123/399

See application file for complete search history.

(56) References Cited

U.S. PATENT DOCUMENTS 5,718,202 A * 2/1998 Bentz et al. ..... 123/399
6,031,448 A * 2/2000 Starkweather et al. ..... 338/106
6,279,535 B1 * 8/2001 Matsusaka ..... 123/399
6,866,027 B1 * 3/2005 Marchesini et al. ..... 123/480
6,889,652 B2 * 5/2005 Meiwes et al. ..... 123/337
7,069,906 B2 * 7/2006 Josten et al. ..... 123/399
2004/0149257 A1 * 8/2004 Meiwes et al. ..... 123/337
2004/0231643 A1 * 11/2004 Josten et al. ..... 123/399
2005/0056261 A1 * 3/2005 Marchesini et al. ..... 123/480

FOREIGN PATENT DOCUMENTS

JP 2001-282303 A 10/2001
JP 2006-097500 A 4/2006

* cited by examiner

*Primary Examiner*—Erick Solis
(74) *Attorney, Agent, or Firm*—Rader Fishman & Grauer PLLC

(57) ABSTRACT

A throttle apparatus embedding an electronic control unit in which a circuit board of the electronic control unit is embedded within a throttle body and a connector for connecting to an external portion connected to a terminal provided in the circuit board protrudes from an outer wall of the throttle body in a direction approximately along a terminal side of the circuit board surface from one side line of the circuit board, wherein the circuit board is storable within the throttle body by selecting an optional mounting direction from at least two or more directions having different angles on the same plane around a center portion of the circuit board, and an insertion portion capable of protruding the connector to an external portion through an outer wall of the throttle body is provided at each of corresponding positions of the outer wall.

4 Claims, 4 Drawing Sheets

THROTTLE APPARATUS EMBEDDING ELECTRONIC CONTROL UNIT THEREIN

BACKGROUND OF THE INVENTION

1. Field of the Invention

The present invention relates to a throttle apparatus embedding an electronic control unit therein, and more particularly to a throttle apparatus of an engine, in which an electronic control unit is embedded within a throttle body, and a connector for connecting to an external portion is exposed to an outer portion of the throttle body.

2. Description of Related Art

In a fuel injection control system mounted to an engine having a comparatively compact and simple structure such as a general purpose engine or the like, there has been widely generalized a structure in which a fuel injection valve, an electronic control unit and the like are integrated with a throttle apparatus regulating an intake air amount. However, it is often the case that a spatial restriction exists in a portion at which the throttle apparatus is positioned, at a time of mounting the general purpose engine to the individual apparatus.

Accordingly, there has been attempted to downsize a whole size by efficiently arranging a plurality of parts necessary for opening and closing a throttle valve, such as a throttle apparatus described in Japanese Unexamined Patent Publication No. 2006-97500. However, since a connector for connecting to an external portion in an electronic control unit is determined an arranging direction on the basis of a terminal position of a circuit board embedded in the throttle body, and protrudes to an outer side largely from an outer wall of the throttle body, it is impossible to dissolve an interference of the connector with the other parts of the engine even if the throttle apparatus is made compact. Accordingly, there is generated a necessity for individually designing the throttle apparatus and the electronic control unit in which mounting positions and angles of the connector are set in correspondence to a spatial condition of the engine to which the throttle apparatus is mounted.

On the contrary, as a system in which the circuit boards for the electronic control are divided functionally so as to be arranged in parallel, and a plurality of connecting positions to the external portion are arranged in a lateral direction so as to be respectively connected to the connectors, such as an electronic control unit, for example, described in Japanese Unexamined Patent Publication No. 2001-282303, there has been proposed a structure in which a connection position arranged in a width direction on the connector can be optionally selected and set.

However, in this electronic control unit, a protruding direction of the connector is limited to one direction on the same plane in the throttle apparatus, and a position is changed within a width of the connector. Accordingly, no problem is generated in the case that a space is formed in a lower side of an air cleaner 50 and a connector 32 protruding from a throttle body 40 is fitted into the space, such as a throttle apparatus 10 shown in FIG. 4A, however, in the case that an air cleaner 51 protrudes to a lower side such as the throttle apparatus 10 shown in FIG. 4B, and the throttle apparatus corresponds to a type in which no space is formed in a lower side of the air cleaner 50 shown in FIG. 4A, the throttle apparatus 40 can not be used as it is.

Accordingly, in order to arrange the connector 32 in a lower side of an intake manifold 61 in an opposite side having a sufficient space, in FIG. 4B, there can be considered to change the structure of the throttle body 40 and the internal electronic control unit, however, a corresponding property and a general purpose property of the parts become low in these cases, and an increase of a cost is caused.

SUMMARY OF THE INVENTION

The present invention is made for solving the problem as mentioned above, and an object of the present invention is to provided a throttle apparatus embedding an electronic control unit in which an exposing direction of a connector for connecting to an external portion can be easily changed in correspondence to a spatial condition of a mounting position, and an excellent general purpose property is generated.

In accordance with the present invention, there is provided a throttle apparatus embedding an electronic control unit in which a circuit board of the electronic control unit is embedded within a throttle body and a connector for connecting to an external portion protrudes from an outer wall of the throttle body in a direction along a terminal side of the circuit board surface from one side line of the circuit board, wherein the circuit board is storable within the throttle body by selecting an optional mounting direction from at least two or more predetermined directions having different angles on the same plane around a center portion of the circuit board, and an insertion portion capable of protruding the connector to an external portion through an outer wall of the throttle body is provided at each of corresponding positions of the outer wall.

Accordingly, in the case of mounting to a general purpose engine or the like in which a freedom of an arranging space is small, a direction of the connector can be easily set to a direction in correspondence to the spatial condition caused by the surrounding engine parts.

Further, the structure may be made such that the circuit board is formed as a symmetrical shape around the center portion thereof in the case of seeing from the plane, and is storable within the throttle body by selecting from two directions which are different at least 180 degree. Since it is generally possible to secure a space for storing the connector in almost all engines by corresponding to two directions which are different 180 degree, it is possible to easily correspond by forming by a comparatively simple shape such as a square shape or the like, and it is possible to reduce a cost.

Further, in the throttle apparatus mentioned above, the structure may be made such that the insertion portion for protruding the connector from the outer wall of the throttle body is constituted by a notch having a shape to which at least the connector is inserted and formed by a cutting line in which a groove having a predetermined depth or a connecting position is left in an outer wall, and a lid member closing the notch, the lid member falls away by applying a force from a predetermined direction and the notch is opened, and the side to which the connector is not inserted maintains a state in which the lid member closes the notch.

Accordingly, it is possible to easily form the insertion portion for inserting the connector, and it is possible to form the notch in accordance with a simple procedure. Further, since the side in which the connector is not necessary is kept in the state in which the insertion portion is closed, it is possible to well keep a waterproof performance inside and outside the throttle apparatus, and it is possible to effectively maintain a strength of the throttle body.

In accordance with the present invention in which the circuit board of the electronic control unit is storable by being changed its direction into the throttle body, it is possible to easily correspond the protruding direction of the connector for connecting to the external portion in correspondence to the spatial condition of the engine mounting position, and it is possible to obtain the throttle apparatus which is extremely excellent in the general purpose property.

DESCRIPTION OF PREFERRED EMBODIMENTS

A description will be given of a best mode for carrying out the present invention with reference to the accompanying drawings.

Figure 1A:
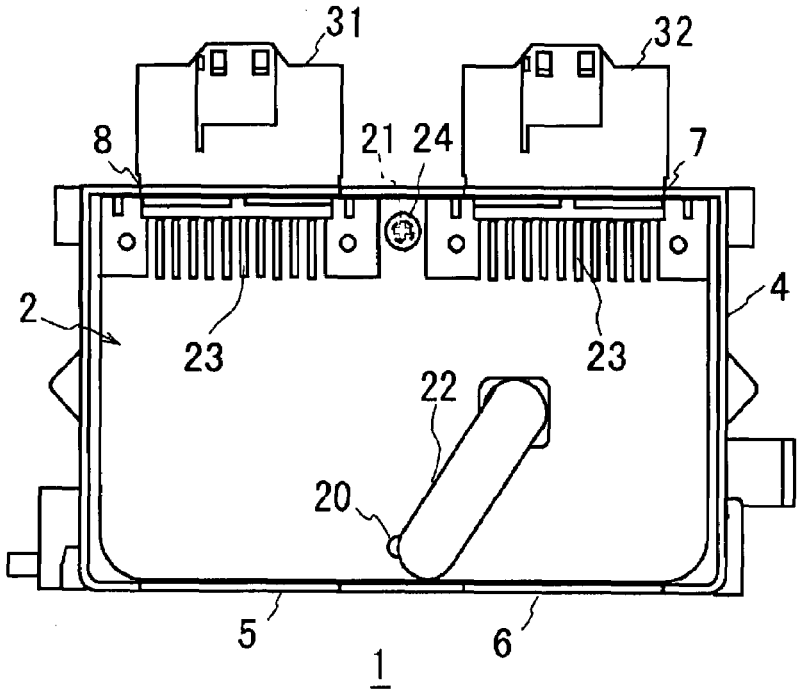
FIG. 1A is a bottom elevational view showing an embodiment in accordance with the present invention.
Figure 1B:
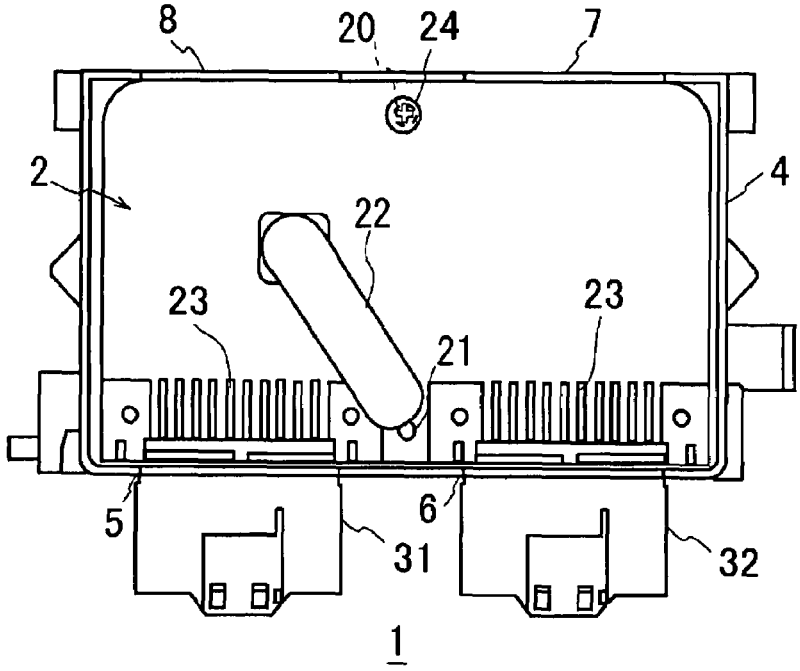
FIG. 1B is a bottom elevational view showing a state in which a circuit board is stored in a throttle body in a direction of being inverted in a vertical direction from a state in FIG. 1A.

FIGS. 1A and 1B show a mounting state of a circuit board 2 serving as an electronic control unit to a throttle body 4, in a throttle apparatus 1 in accordance with the present embodiment. The throttle apparatus 1 is structured such as to regulate an intake air amount in a general purpose engine, however, is structured such as to mount a fuel injection valve (not shown) thereto, and embed the circuit board 2 corresponding to an electronic control unit therein, thereby automatically executing various controls.

Further, the circuit board 2 is characterized in that the circuit board 2 is formed approximately in a rectangular shape in a plan view, has a symmetrical outline around a center portion thereof, can be installed in a throttle body 4 by selecting both directions comprising a state in FIG. 1A and a state in FIG. 1B, and can select directions of connectors 31 and 32 protruding to an outer portion of the throttle body 4 in a direction along terminals 23 and 23 of the circuit board 2 from one side line thereof in two different directions at inverted directions (that is, positions rotated 180 degree) in a vertical direction.

Describing further in detail, in the state shown in FIG. 1A, the circuit board 2 is fixed to the throttle body 4 side while being inserted to a thread hole 21 by a screw 24, and the connectors 31 and 32 are set upward in the drawing. On the contrary, in the case that it is necessary to attach while directing the connectors 31 and 32 to a lower side in the drawing under a spatial condition of an engine mounting portion, the structure is made such as to insert the circuit board 2 to a thread hole 20 by the screw 24 in a direction of being inverted in the vertical direction as shown in FIG. 1B so as to fix to the throttle body 4 side while keeping the direction of the throttle body 4 as it is, and set the directions of the connectors 31 and 32 to a downward directions in the drawing in correspondence to the terminals 23 and 23, whereby it is possible to easily change various connections to the throttle body 4 side such as a connection pipe 22, a wiring (not shown) and the like.

Figure 3A:
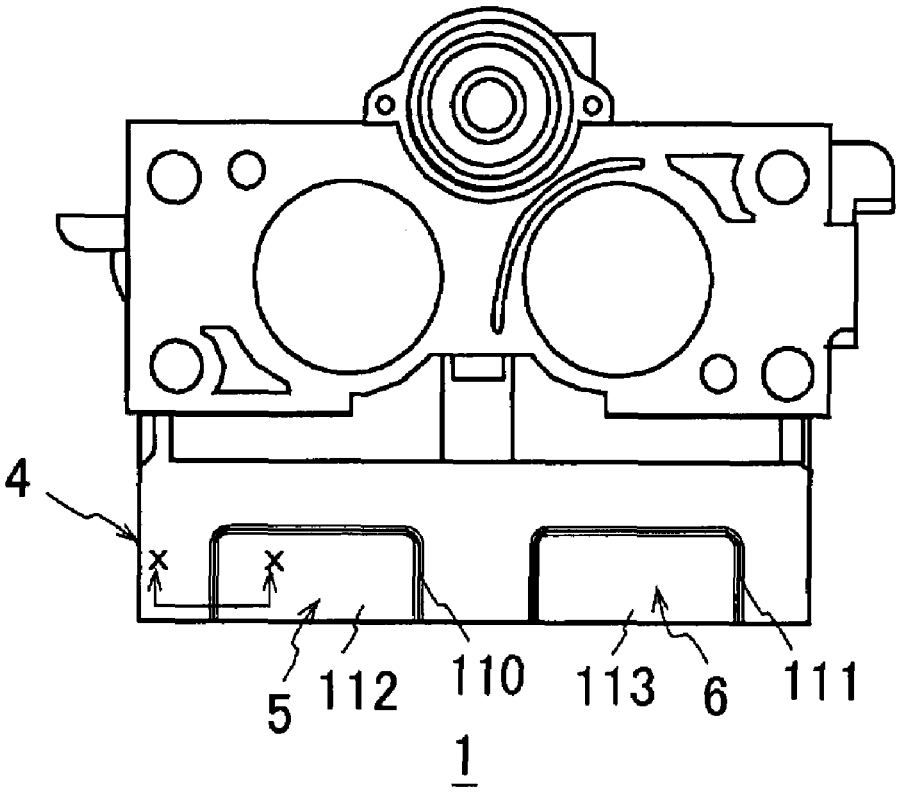
FIG. 3A is a side elevational view of a throttle apparatus in FIG. 1A or 1B.
Figure 3B:
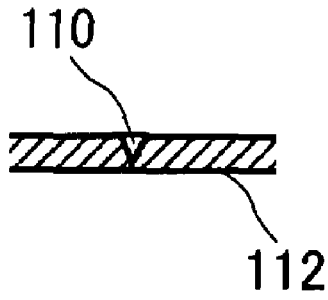
FIG. 3B is an enlarged partial view by a cross section along a line X-X in FIG. 3A.

In this case, a structure for inserting the connectors 31 and 32 through an outer wall of the throttle body 4 is necessary, however, insertion portions 5 and 6 forming notches having shapes through which the connectors 31 and 32 can be inserted are provided at a corresponding position of the throttle body 4 (insertion portions 7 and 8 are provided in an opposed surface (not shown), as shown in a side elevational view of a state before attaching an air cleaner or the like of the throttle apparatus 1 in FIG. 3A.

In other words, as shown in an enlarged partial view by a cross section along a line X-X in FIG. 3A, grooves 110 and 111 are formed on an outer wall of the throttle body 4 in a V-shaped cross sectional form and approximately in a rectangular shape in a side elevational view from a front surface side, inner sides thereof are formed as lid members 112 and 113, the lid members can be comparatively easily broken so as to be detached by applying a force thereto from an outer side, and the notches are opened by detaching. In this case, in addition to the means for forming the insertion portion by the groove, a cutting line may be provided by a break line formed by leaving connection positions at a predetermined interval.

In accordance with the structure mentioned above, it is possible to form the notch in accordance with the simple procedure in correspondence to the directions of the connectors 31 and 32 so as to protrude from the outer wall of the throttle body 4. Further, since a slight man hour constituted only by the provision of the groove on the outer wall of the throttle body 4 is sufficient, an increase of a manufacturing cost is hardly generated. Further, since the side in which the lid member is not detached is kept being closed without the notch being opened, it is easy to avoid an intrusion of a water content or an oil content into the throttle apparatus 1, and it is possible to stand against a vibration or the like so as to obtain an excellent durability.

Figure 2A:
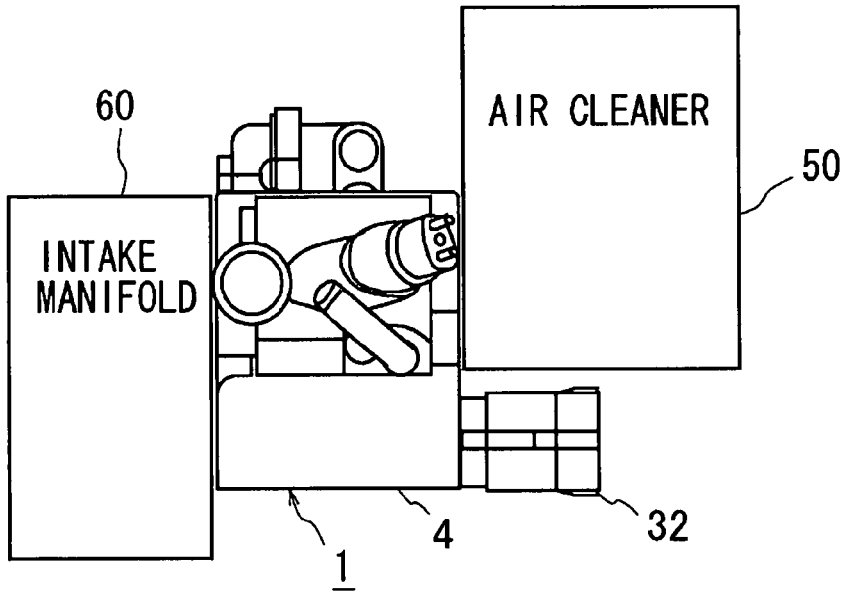
FIG. 2A is a front elevational view showing a case that a mounting position of a connector is changed.
Figure 2B:
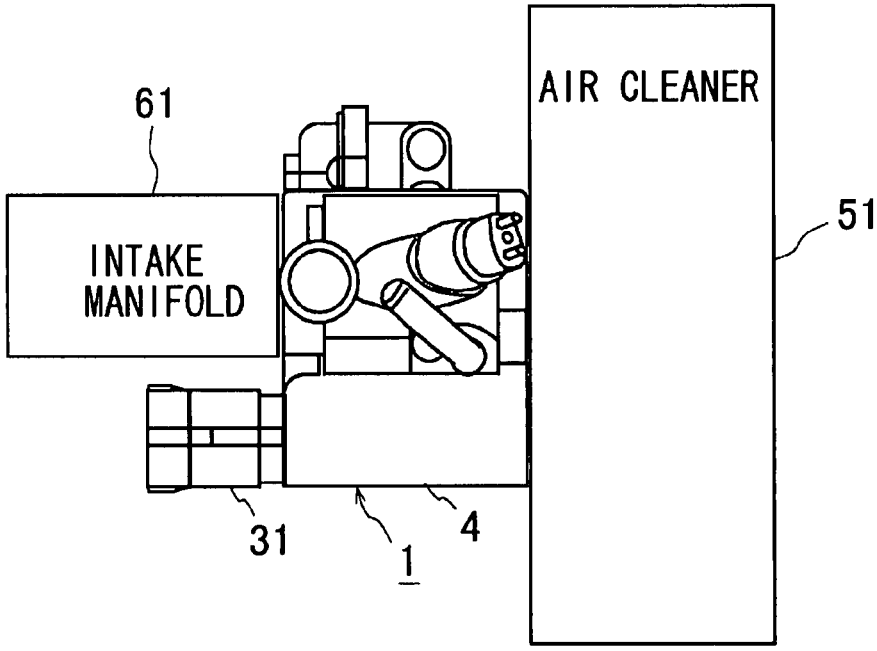
FIG. 2B is a front elevational view showing a case that a mounting position of a connector is changed.
Figure 4A:
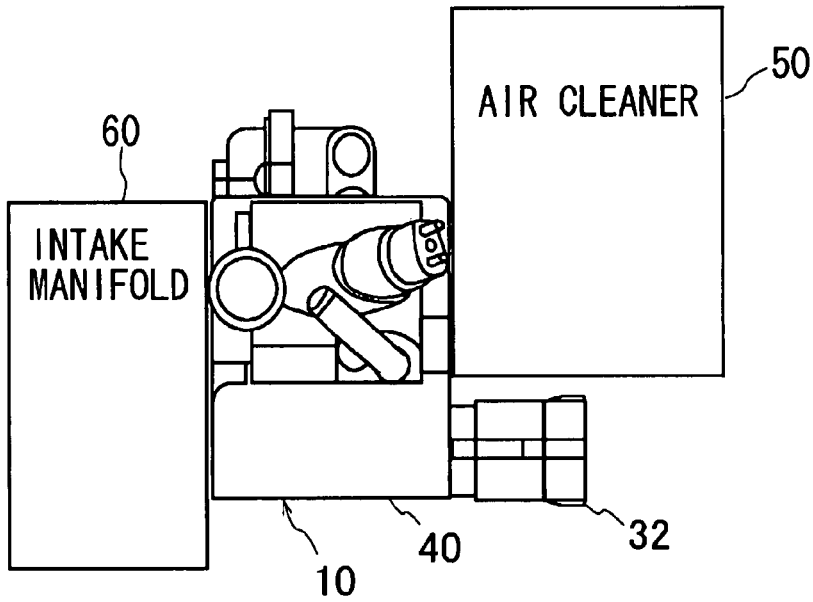
FIG. 4A is a front elevational view showing a mounting state of a connector in a prior art.
Figure 4B:
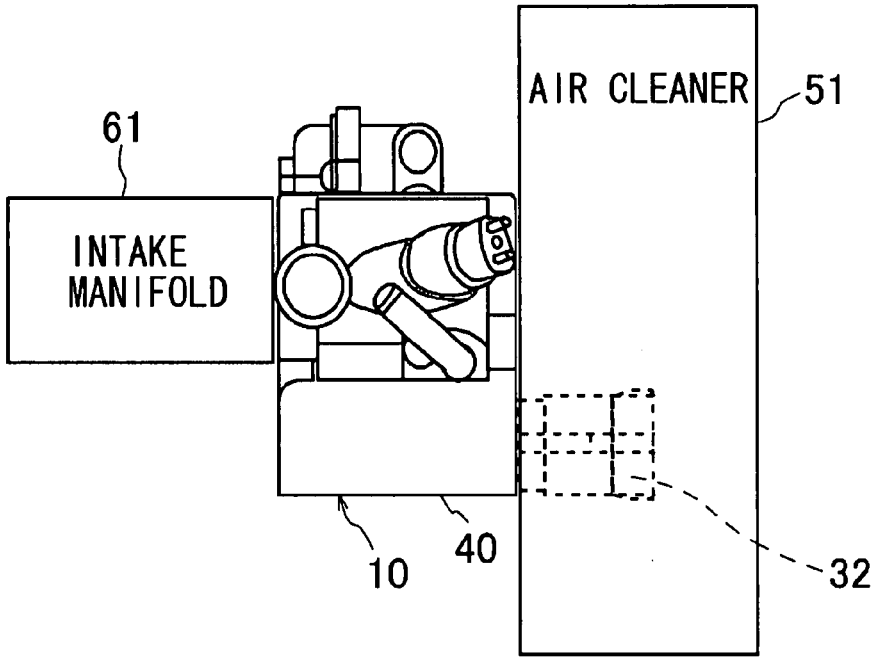
FIG. 4B is a front elevational view showing a mounting state of a connector in a prior art.

Accordingly, the throttle apparatus 1 in accordance with the present embodiment can set such that the connectors 31 and 32 protrude from a right side in the drawing in the case that the intake manifold 60 protrudes into a lower portion of a left side surface in the drawing of the throttle body 4 as shown in FIG. 2A, and can set such that the connectors 31 and 32 protrude from a left side in the drawing in the case that the air cleaner 51 protrudes into a lower portion of a right side in the drawing of the throttle body 4 as shown in FIG. 4B, and a man hour at a time of setting is slight.

In this case, in the description mentioned above, the description is given of the case that the present invention is applied to the general purpose engine, however, the present invention can be applied to a kind of engine in which the electronic control unit is embedded in the throttle body, and a spatial limit of the engine mounting position is generated by the protrusion of the connector in the same manner, and the same effect can be expected. Further, the description is given of the case that the direction of the connector can be selected in two directions, however, for example, if the circuit board is formed in a square shape, and the mounting portion in the throttle body side is formed in the corresponding shape thereto, it is possible to select in four directions.

The invention claimed is:

1. A throttle apparatus embedding an electronic control unit in which a circuit board of the electronic control unit is embedded within a throttle body and a connector for connecting to an external portion connected to a terminal provided in the circuit board protrudes from an outer wall of the throttle body in a direction approximately along a terminal side of the circuit board surface from one side line of the circuit board, wherein the circuit board is storable within the throttle body by selecting an optional mounting direction from at least two or more directions having different angles on the same plane around a center portion of the circuit board, and an insertion portion capable of protruding the connector to an external portion through an outer wall of the throttle body is provided at each of corresponding positions of the outer wall.

2. A throttle apparatus embedding an electronic control unit as claimed in claim 1, wherein the circuit board is formed as a symmetrical shape around the center portion thereof in the case of seeing from the plane, and is storable within the throttle body by selecting from two directions which are different at least 180 degree.

3. A throttle apparatus embedding an electronic control unit as claimed in claim 1, wherein the insertion portion for protruding the connector from the outer wall of the throttle body is constituted by a notch having a shape to which at least the connector is inserted and formed by a cutting line in which a groove having a predetermined depth or a connecting position is left in an outer wall, and a lid member closing the notch, the lid member falls away by applying a force from a predetermined direction and the notch is opened, and the side to which the connector is not inserted maintains a state in which the lid member closes the notch.

4. A throttle apparatus embedding an electronic control unit as claimed in claim 2, wherein the insertion portion for protruding the connector from the outer wall of the throttle body is constituted by a notch having a shape to which at least the connector is inserted and formed by a cutting line in which a groove having a predetermined depth or a connecting position is left in an outer wall, and a lid member closing the notch, the lid member falls away by applying a force from a predetermined direction and the notch is opened, and the side to which the connector is not inserted maintains a state in which the lid member closes the notch.

* * * * *